United States Patent [19]

Herbert et al.

[11] Patent Number: 5,077,178

[45] Date of Patent: Dec. 31, 1991

[54] FULL COLOR PHOTOTHERMOGRAPHIC IMAGING SYSTEM

[75] Inventors: Alan J. Herbert, Austin, Tex.; Susan K. Jongewaard, North St. Paul; David R. Whitcomb, Woodbury, both of Minn.

[73] Assignee: Minnesota Mining and Manufacturing Company, St. Paul, Minn.

[21] Appl. No.: 554,394

[22] Filed: Jul. 19, 1990

[51] Int. Cl.[5] ..... G03C 9/24; G03C 1/52

[52] U.S. Cl. ..... 430/340; 430/333; 430/336; 430/338; 430/341; 430/342; 430/343; 430/344

[58] Field of Search ..... 430/338, 339, 336, 341, 430/342, 343, 344, 340, 333

[56] References Cited

U.S. PATENT DOCUMENTS

| | | | |
|---|---|---|---|
| 4,370,401 | 1/1983 | Winslow et al. | 430/339 |
| 4,386,154 | 5/1983 | Smith et al. | 430/338 |
| 4,452,883 | 6/1984 | Frenchik et al. | 430/338 |
| 4,460,677 | 6/1984 | Smith et al. | 430/344 |
| 4,460,681 | 6/1984 | Frenchik | 430/338 |
| 4,647,525 | 3/1987 | Meller | 430/338 |

*Primary Examiner*—Charles L. Bowers, Jr.
*Assistant Examiner*—Thorl Chea
*Attorney, Agent, or Firm*—Gary L. Griswold; Walter N. Kirn; Gregory A. Evearitt

[57] ABSTRACT

Disclosed are photothermographic constructions containing at least a plurality of light-sensitive layers which are separated by barrier layers composed of a polymer, e.g., ethyl cellulose and polyethylene terephthalate, having an energy activation of permeability ($E_p$) of less than about 30 kJ/mole. The barrier layers must be substantially insoluble in the light sensitive layers and vice versa. Each light sensitive layer contains a nitrate salt, leuco dye, binder, and optionally, a photoinitiator. The photothermographic construction is capable of effectively reproducing full color images.

16 Claims, No Drawings

FULL COLOR PHOTOTHERMOGRAPHIC IMAGING SYSTEM

FIELD OF THE INVENTION

This invention relates to light-sensitive imaging systems capable of full color reproduction. In particular, the present invention relates to photothermographic full color non-silver imaging systems.

BACKGROUND OF THE INVENTION

Full color imaging systems are well known in the art. In the past, they have been based extensively upon silver halides (see, for example, Krause, P., *Imaging Processes and Materials,* 8th ed.; Sturge, J.; Walworth, V.; Shepp, A., Eds.; Van Nostrand Reinhold; New York, 1989; pp. 110–34); dry silver (e.g., U.S. Pat. Nos. 2,772,971, 2,78,625, 2,623,823, and 2,594,917); and microencapsulated (e.g., U.S. Pat. No. 4,576,891) technologies for image reproduction. Because of their extreme sensitivity to light, silver halide systems have been the most widely used.

The use of barrier layers to separate the chemistry of imaging layers in full color silver halide systems has been employed in the past (see, for example, Krause, P., *Imaging Processes and Materials,* 8th ed., et al., p. 120). In the silver halide systems, the principal role of the barrier layer has been to keep the chemistries of the individual imaging layers separated and thus avoid the poor quality reproduced images which result from interference or "cross-talk" between the chemistries of the individual layers. Gelatin based barrier layers have typically been employed in silver based systems.

Although silver halide based systems have been satisfactory for their intended use, the photographic industry has searched for alternatives. Silver based systems can sometimes be inconvenient to use, particularly where wet processing is utilized, and furthermore, the cost of silver can be prohibitively expensive.

To that end, photothermographic systems have become known in the art. As the term implies, photothermographic systems rely upon heat to develop a radiation generated latent image. One type of construction for these photothermographic systems incorporates one or more nitrate salt/leuco dye based light sensitive imaging layers. As is known, the nitrate salt undergoes decomposition upon application of heat (e.g., 80° to 90° C.) to generate various intermediate vaporous products, one of which will oxidize the leuco dye so that the dye can then express its specific color in the reproduced image. U.S. Pat. Nos. 4,386,154, 4,460,677, 4,370,401, and 4,394,433 disclose photothermographic nitrate ion based imaging systems. Japanese Patent Nos. 77/025,330, 77/004,180, and 79/001,453 disclose nitrate ion oxidation mediate photothermographic materials and U.S. Pat. Nos. 4,336,323 and 4,373,020 disclose bleachable nitrate containing systems. However, none of the foregoing teach the use of barrier layers to separate imaging layers or their use in the construction of a full color imaging system. No problems which would require barrier layers in such photothermographic systems are known to have been reported to date in the trade or patent literature.

Because of the practical advantages of using photothermographic systems over silver based systems, there has been a demand in the photographic industry for improved full color photothermographic systems which utilize a plurality of light sensitive layers. The use of a plurality of light sensitive layers, each layer containing a different color system, is advantageous because a more saturated full color image can be reproduced. However, the industry has found itself lacking the availability of such multi-light sensitive layered photothermographic systems. There is also an inherent difficulty that exists in developing a suitable barrier layer which would be necessary to separate the individual light sensitive layers.

The difficulty in developing a suitable barrier layer for a non-silver based, imaging system resides in the fact that such a barrier layer must possess properties beyond those which are necessary in barrier layers of silver based imaging systems. In a photothermographic system containing a plurality of light sensitive layers, a barrier layer must have a unique and very careful balance of several properties.

Additional considerations are necessary when developing an effective photothermographic imaging system for at least a couple of important reasons, all of which are due in part to the complicated chemical nature of the light sensitive layers in photothermographic systems. To begin with, as explained earlier, the decomposition of the nitrate salt present in the light sensitive layer results in various intermediate vaporous products. The various vaporous intermediates which do not participate in the oxidation of the leuco dye and thus, are not absorbed by the dye, can accumulate to the point where pressure builds up in the individual light sensitive layers. If the vapors are not released, an undesirable "blistering" of the final multi-colored image will result. Thus, one is confronted with the situation that whereas a barrier coating must be somewhat impermeable to the oxidizing vaporous intermediates in order to prevent cross-talk from occurring between the individual light sensitive layers, the barrier coating must also have some degree of permeability so that vapors do not accumulate in the individual layers.

Additionally, the light sensitive layers and the barrier layers must be substantially insoluble in one another. That is, when the barrier layer is coated on top of a dried light-sensitive layer or vice versa, not more than 5 wt% of the critical imaging ingredients (e.g., dye, photosensitive agent, nitrate salt, etc.) of the bottom layer should leach, migrate, be extracted into, intermix with or otherwise be transferred to the top layer.

In view of the foregoing, it is clear that the development of a suitable barrier coating for use in a photothermographic system containing multiple light sensitive layers poses special considerations not previously required in the development of more traditional silver based imaging systems. Consequently, there has existed in the past a void in the photographic industry for this kind of product. It was against this background that a search was begun for a suitable photothermographic system which would overcome the above mentioned difficulties and fulfill the needs of the industry.

BRIEF SUMMARY OF THE INVENTION

In accordance with this invention, it has been discovered that only organic polymeric materials which have an $E_p$ value of less than about 30 kJ/mole possess the careful balance of properties necessary to function as an effective barrier layer between the plurality (two or more) of light sensitive layers present in a multicolor or full color photothermographic imaging system. As used herein (and as defined more fully later herein) "$E_p$"

refers to the activation energy of permeability of the organic polymeric constituent which comprises the barrier layer. Representative non-limiting examples of specific organic polymeric materials which have an $E_p$ less than about 30 kJ/mole include polyacrylamide, polyvinyl alcohol, ethyl cellulose, cellulose acetate, and others as disclosed later herein. The $E_p$ value of less than about 30 kJ/mole for the organic constituent(s) of the barrier coating is important because organic materials which have an $E_p$ value above that level have not been found to function as effective barrier layers in the photothermographic constructions of this invention.

Thus, in accordance with the present invention, there is provided a photothermographic construction comprising a substrate coated thereon with two or more light-sensitive layers. The light sensitive layers comprise a nitrate salt, leuco dye, binder, and optionally, a photoinitiator and an acid, and the light-sensitive layers are separated by barrier layers comprising an organic polymer having an activation energy of permeability ("$E_p$" as defined later herein) of less than about 30 kJ/mole. Additionally, the barrier layers and light-sensitive layers should be substantially insoluble in one another when coated next to each other. In a preferred embodiment, the photothermographic construction contains three (3) light-sensitive layers which are individually sensitive to different regions of the electromagnetic spectrum such as red, green, and blue light.

As will be clearly seen from the examples later herein, the barrier layers utilized in the present invention which possess an $E_p$ value of less than about 30 kJ/mole are very effective in photothermographic systems as opposed to layers which possess an $E_p$ value of greater than about 30 kJ/mole which are outside the scope of the present invention.

The barrier layer used in the photothermographic constructions of the present invention are effective because they are able to accommodate the balance of special properties which are necessary in a barrier layer when utilized in nitrate salt/leuco dye light sensitive containing systems. To begin with, the barrier layer utilized in the present invention possesses the balance between permeability/nonpermeability that is necessary in a photothermographic system. The necessary balance of properties is achieved by the barrier layers because on the one hand they are impermeable to the leuco dye oxidizing vaporous intermediate which would cause cross-talk between the light-sensitive layers if the intermediate was allowed to escape to a light sensitive layer from the layer that it originated in. On the other hand, the barrier layers are also permeable enough to allow other vaporous intermediates to escape from the system, thereby preventing the formation of "blisters" on the reproduced image.

The barrier layer utilized in the present invention must be substantially insoluble in the light-sensitive layers and vice versa. As used herein, the term "substantially insoluble" means that no more than about 5 wt% of the total of active, image forming ingredients of the bottom layer should be transferred (e.g., through extraction, leaching, absorption, and the like) to the top layer when it is coated on the dried bottom layer.

Other aspects and advantages of the present invention are apparent from the detailed disclosure, examples, and claims.

DETAILED DESCRIPTION OF THE INVENTION

The present invention comprises photothermographic constructions which comprise a substrate coated thereon with a plurality of light-sensitive layers, wherein the light-sensitive layers comprise a nitrate salt, leuco dye, binder, and, optionally, a photoinitiator and/or acid; and further wherein the light-sensitive layers are separated by barrier layers comprising an organic polymer having an activation energy of permeability less than about 30 kJ/mol and each barrier layer is substantially insoluble in the light-sensitive layers and vice versa.

The individual components of the photothermographic construction of the present invention are discussed in detail hereinbelow.

Substrates

The light-sensitive and barrier layers are coated on a suitable substrate in the present invention. Suitable substrates may be used in the present invention include, but are not limited to, metals (e.g., steel and aluminum plates, sheets, and foils); films or plates composed of various film-forming synthetic or high polymers including thermoplastic or crosslinked addition polymers (e.g., polyvinylidene chloride, polyvinyl chloride, polyvinyl acetate, polystyrene, polyisobutylene polymers and copolymers), and linear condensation polymers (e.g., polyethylene terephthalate, polyhexamethylene adipate, polyhexamethylene adipamide/adipate); nonwoven wood by-product based substrates such as paper and cardboard; and glass. Substrates may be transparent or opaque.

Light Sensitive Layer

The light sensitive layers utilized in the present invention each comprise a nitrate salt, leuco dye, binder, and, optionally, a photoinitiator and/or acid.

A. Nitrate Salt

Nitrate salts are well known. See, for example, U.S. Pat. Nos. 3,741,769, 4,370,401, 4,394,433, 4,460,677, 4,386,154, 4,336,323, and 4,373,020. They may be supplied as various chemical compounds, but are desirably provided as a metal salt, and most preferably provided as a hydrated metal salt. Examples of nitrate salts which may be used in the present invention include, but are not limited to, nitrates of zinc, cadmium, potassium, calcium, zirconyl ($ZrO_2$), nickel, aluminum, chromium, iron, copper, magnesium, lithium, lead and cobalt, ammonium nitrate, cerous ammonium nitrate, and combinations of the above have been used.

The nitrate salt component of the present invention is desirably present in a form within the imaging layer so the oxidizing quantities of $HNO_3$, NO, $NO_2$, or $N_2O_4$ will be provided within the layer (upon decomposition of the nitrate salt) when it is heated to a temperature no greater than 200° C. for 60 seconds and preferably no greater than 160° C. for 60 or most preferably 30 seconds. This may be accomplished with many different types of nitrate salts, both organic and inorganic, and in variously different types of constructions. The most convenient way of providing such oxidizing nitrate salts is to provide a hydrated nitrate salt such as magnesium nitrate hexahydrate ($Mg(NO_3)_2 \times 6\ H_2O$). In addition to hydrated nitrate salts, non-hydrated salts such as ammonium nitrate, pyridinium nitrate, and guanidinium nitrate in an acidic environment are also capable of providing the oxidizing capability necessary for practice of the present invention.

Besides the inorganic type of salts generally described above, organic salts in non-alkaline environments are also quite useful in the practice of the present invention. In particular, nitrated quaternary ammonium salts such as guanidinium nitrate work quite well in acidic environments, but will not provide any useful image in a basic environment. It is believed that the alkaline environment causes any oxidizing agent (e.g., $HNO_3$, NO, $NO_2$, and/or $N_2O_4$) which is liberated from the nitrate salt to be neutralized so as to prevent oxidation of the leuco dyes. For this reason, it is preferred to have an acidic environment for the nitrate salt.

Preferably, the nitrate salt utilized in the present invention is one in which the cation is non-reactive with the dye. Non-reactive salts are defined in the practice of the present invention as those salts in which the cations thereof does not spontaneously oxidize the leuco dyes that they are associated with at room temperature. This may be determined in a number of fashions. For example, the dye and a non-nitrate (preferably halide) salt of the cation may be codissolved in a solution. If the salt oxidizes the dye spontaneously (within two minutes) at room temperature, it is a reactive salt. Such salts as silver nitrate, in which the cation itself is a strong oxidizing agent, is a reactive salt. Ceric nitrate is also reactive, while hydrated cerous nitrate is not.

Preferred salts are the hydrated metal salts such as nickel nitrate hexahydrate, magnesium nitrate hexahydrate, aluminum nitrate nonahydrate, ferric nitrate nonahydrate, cupric nitrate trihydrate, zinc nitrate hexahydrate, cadmium nitrate tetrahydrate, bismuth nitrate pentahydrate, thorium nitrate tetrahydrate, cobalt nitrate hexahydrate, bismuth nitrate pentahydrate, thorium nitrate tetrahydrate, cobalt nitrate hexahydrate, gadolinium orlanthanum nitrate nonahydrate, mixtures of these hydrated nitrates and the like. Nonhydrated (e.g., lithium nitrate) or organic nitrates may be admixed therewith.

It is preferred to have at least 0.10 moles of nitrate ion per mole of leuco dye. It is more preferred to have at least 0.30 or 0.50 moles of ion per mole of dye. The nitrate ordinarily constitutes from 0.05 to 10 percent by weight of the imaging layer, preferably 0.1 to 10 percent and most preferably 0.5 to 8 percent by weight.

B. Leuco Dye

Leuco dyes are well known. These are colorless compounds which when subjected to an oxidation reaction form colored dyes. These leuco dyes are well described in the art (e.g., U.S. Pat. No. 3,974,147 (Tiers), *The Theory of Photographic Process,* 3rd ed.; Mees, C. E. K.; James, T. H., Eds.; MacMillan: New York, 1966; pp. 283–4, 390–1; and *Light-Sensitive Systems;* Kosar, J.; Wiley and Sons, New York, 1965; pp. 367, 370–380, 406. Only those leuco dyes which can be converted to colored dyes by oxidation are useful in the practice of the present invention. The preferred leuco dyes are the acylated leuco diazine, phenoxazine, and phenothiazine dyes, examples of which are disclosed in U.S. Pat. Nos. 4,460,677 (Olofson), 4,647,525 (Miller), and Great Britain Patent No. 1,271,289 (Wiggins Teape).

Acid or base sensitive dyes such as phenolphthalein and other indicator dyes are not useful in the present invention. Indicator dyes form only transient images and are too sensitive to changes in the environment.

The leuco dye should be present as at least about 0.3 percent by weight of the total weight of the light sensitive layer, preferably at least 1 percent by weight, and most preferably at least 2 percent to 10 percent or more (e.g., 15 percent) by weight of the dry weight of the imageable layer. About 10 mole percent of the nitrate/leuco dye is minimally used, with 20 to 80 mole percent preferred and from 35 to 65 mole percent most preferred. Molar percentages of nitrate/dye in excess of 100 percent are definitely used. The leuco dye ordinarily constitutes from 0.5 to 15 percent by weight of the imaging layer, preferably 2 to 8 percent.

C. Binder

Any natural or synthetic water-insoluble polymeric binder may be used in the practice of this invention Organic polymeric resins, preferably thermoplastic resins (although thermoset resins may be used) are generally preferred. Where speed is important, water-insoluble, water impermeable, water resistant polymers should be used and an acid should be added to the system to increase the rate of colorizing (i.e., leuco dye oxidation). Such resins as phenoxy resins, polyesters, polyvinyl resins, polycarbonates, polyamides, polyvinyl acetals, polyvinylidene chloride, polyacrylates, cellulose esters, copolymers and blends of these classes of resins, and others have been used with particular success. Where the proportions and activities of leuco dyes and nitrate ion require a particular developing time and temperature, the resin should be able to withstand those conditions. Generally, it is preferred that the polymer not decompose or lose its structural integrity at 200° F. (93° C.) for 30 seconds and most preferred that it not decompose or lose its structural integrity at 260° F. (127° C.) for 30 seconds. Preferred polymers include polyvinylidene chloride resins (e.g., Saran TM supplied by Dow Chemical, Midland, MI), phenoxy resins (e.g., PKHH TM and PAHJ TM supplied by Union Carbide, Hackensack, NJ), and polyvinyl formals (e.g., Formvar TM supplied by Monsanto Chemical, St. Louis, MO).

It is further required that the binder be transparent in layers through which light must pass, although transparency and translucency are not required in the base imaging layer but are desirable. The binder serves a number of additionally important purposes in the constructions of the present invention. The imageable materials are protected from ambient conditions such as moisture. The consistency of the coating and its image quality are improved. The durability of the final image is also significantly improved. The binder should be present as at least about 25 percent by weight of ingredients in the layer, more preferably as 50 percent or 70 percent by weight and most preferably as at least about 80 percent by weight of dry ingredients (i.e., excluding solvents in the layer). A generally useful range is 30–98 percent by weight binder with 75 to 95 percent preferred.

D. Photoinitiator

The present invention may be practiced with or without an added photoinitiator. Examples of typical photoinitiators include diaryliodonium salts and organic compounds with photolyzable halogen atoms. An initiator generally increases the photosensitivity of the image-forming layer but decreases its thermal stability.

Representatives of the diaryliodonium salts useful in this invention are those disclosed in U.S. Pat. No.

4,460,154, and may have either two distinct aryl groups which may be different or the same, or they may be connected by one or more bonds so that a cyclic iodonium salt results. The counterion of the iodonium salt may be any non-interfering anion (e.g., hexafluorophosphate, hexafluoroarsenate, p-toluene sulfonate, chloride, iodide, bromide, and the like).

Representatives of the organic compounds having photolyzable halogen atoms which are useful in this invention are those disclosed in U.S. Pat. Nos. 4,460,677 and 4,386,154.

E. Acidic Materials

Acidic materials may optionally be added to the light-sensitive layer to increase its speed. Such acids are generally known to those skilled in the art. Organic acids are preferred, but inorganic acids (generally in relatively small concentrations) are also useful. Organic acids having carboxylic groups are most preferred. The acid should be present in at least about 0.1 percent by weight of the total weight of an individual light sensitive layer. More preferably, it is present in amounts from 0.2 to 2.0 times the amount of nitrate ion. The acid may, for example, be present in a range of 0.2 to 2.0 times the amount of nitrate ion. The acid may, for example, be present in a range of from 0.05 to 10 percent by weight, preferably from 0.1 to 7 percent, more preferably from 0.5 to 5 percent. Higher molecular weight acids are generally used at the higher concentrations and lower molecular weight acids used in the lower concentrations. Non-limiting examples of acids which may be utilized in the present invention include, but are not limited to acetic acid, propionic acid, and succinic acid.

In forming or coating imageable layers onto a substrate, temperatures should, of course, not be used during manufacture which would completely colorize the layer or decompose the sensitizing dye. Some colorization is tolerable, with the initial leuco dye concentrations chosen so as to allow for anticipated changes. It is preferred, however, that little or no leuco dye be oxidized during forming and coating so that more standardized layers can be formed. Depending on the anticipated development temperature, the coating or forming temperature can be varied. Therefore, if the anticipated development temperature were, for example, 220° F. (104° C.), the drying temperature would be 140° F. (60° C.). It would therefore not be likely for the layer to gain any of its optical density at the drying temperature in less than 6–7 minutes. A reasonable development temperature range is between 160° F. (71° C.) and 350° F. (177° C.) and a reasonable dwell time is between 3 seconds and 2 minutes, preferably at between 175° F. (79° C.) and 250° F. (121° C.) for 5 to 60 seconds, with the longer times most likely associated with the lower development temperatures.

The individual image-forming layers of the present invention must under some conditions allow reactive association amongst the active ingredients in order to enable imaging. That is, the individual ingredients may or may not be separated by impenetrable barriers (i.e., which cannot be dissolved, broken, or disrupted during use) within an individual image-forming layer. Generally, the active ingredients are homogeneously mixed (e.g., a molecular mixture) within an individual image-forming layer. They may be individually maintained in heat softenable binders which are dispersed or mixed within the layer and which often upon heating to allow migration of ingredients, but this would require a longer development time. The ingredients may be incorporated into a binder medium, fine particles of which may be subsequently dispersed in a second layer binder medium as described in U.S. Pat. No. 4,708,928.

The imageable layers of the present invention may contain various materials in combination with the essential ingredients of the present invention. For example, plasticizers, coating aids, antioxidants (e.g., ascorbic acid, hindered phenols, phenidone, etc. in amounts that would prevent oxidation of dyes when heated), surfactants, antistatic agents, waxes, ultraviolet radiation absorbers, mild oxidizing agents in addition to the leuco dye oxidizing acid salt, and brighteners may be used without adversely affecting the practice of the present invention.

In a preferred embodiment of the present invention, these image layers will be present in the photothermographic construction and the layers will be sensitive to, respectively, red, green, and blue light, such that cyan, magenta, and yellow substractive images are respectively created.

Preferably, the thickness of each light-sensitive layer will be in the range of 0.25–4.0 mil, and preferably 0.25–2.0 mil.

Barrier Layer

The barrier layers utilized in the present invention are positioned between the individual light-sensitive layers. Each barrier layer will comprise an organic polymeric material which has an activation energy of permeability ($E_p$) value less than about 30 kJ/mole. Polymeric materials with $E_p$ values above about 30 kJ/mole have not been found to be effective barrier layers in photothermographic systems.

In general, the permeability of polymers to gases may be determined by measuring the flow of gas through a polymeric membrane as detailed in *ASTM Standards*, 1989, 15.09, 255. The permeability P is related to $P_o$ (the permeability at standard temperature and pressure) by the following equation:

$$P = P_o exp(-E_p/RT)$$

The activation energy of permeability ($E_p$) is obtained from the slope (equal to $-E_p/R$) of a linear plot of log P vs. 1/T obtained by measurement of permeabilities at various temperatures.

Additionally, the barrier layer must be substantially insoluble in the light-sensitive layer and vice versa. Thus, when one layer is coated on top of the other, no more than about 5 wt% of the ingredients should migrate from the bottom layer into the top layer.

Preferably, the barrier layer used in the present invention is water soluble and organic solvent insoluble. Thus, when a barrier layer is coated onto a light-sensitive image forming layer, it does not react with the light-sensitive layer, and further when overcoated with a second light-sensitive layer, it is not affected by the overlayer.

There are only a limited number of barrier layer materials that meet the criteria of having low permeability at ambient temperatures and a low activation energy of permeability (i.e., less than about 30 kJ/mol), while remaining impervious to the volatile reactants involved in development and the organic solvents used in the production process. Materials which serve as effective barrier layers in the present invention include, but are not limited to, polyacrylamide, polyvinyl alcohol, ethyl cellulose; polyethylene terephthalate; styrene-butadiene copolymers; cellulose acetate; chlorotrifluoroethylene and vinylidene fluoride copolymers (KEL F800, 3M, St. Paul, MN).

Materials which do not function as useful barrier layer materials in the present invention include, but are not limited to, styrene-acrylonitrile copolymers; polyvinyl butyral; Bisphenol A-epichlorohydrin copolymers; polyvinylidene chloride; polyvinyl chloride-vinyl acetate copolymers; polyvinyl chloride; polystyrene; vinylidene-acrylate copolymers; polyvinyl acetate; and ethylene-propylene copolymers.

Preferably, the thickness of the barrier layers utilized in the present invention will be in the range of about 1–20 microns, and preferably about 3–8 microns.

The following non-limiting examples further illustrate the present invention.

The materials employed below may be obtained from Aldrich Chemical Co (Milwaukee, WI) unless otherwise specified: Oxonol dyes Y1A, M4A, C1A are described in U.S. Pat. No. 4,701,402.

EXAMPLE 1

This example describes the preparation of a multicolor photothermographic imaging system, in which the imaging layers are separated by a barrier layer. Two individual color sensitive layers were prepared as described:

| Cyan Layer: (first layer, knife coated at 4 mil wet thickness, air dried) | |
|---|---|
| 1.50 g | PKHH TM (bisphenol A-epichlorohydrin copolymer, Union Carbide, Tarrytown, NY) |
| 0.08 g | Pergascript TM Turquoise S-2G (Ciba-Geigy, Ardsley, NY) |
| 0.06 g | 1-methyl-3,5-trichloromethyl-s-triazine |
| 2 mg | SCB Squarylium sensitizer (prepared according to Jap. Kokai 60,224,674) has the structure: |

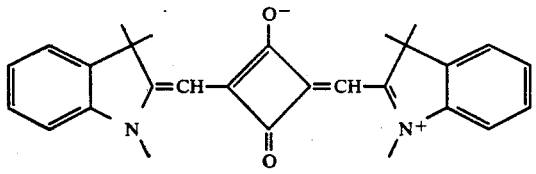

| | |
|---|---|
| 0.92 g | magnesium nitrate solution (made by dissolving 0.26 g of magnesium nitrate hexahydrate in 9 g of methanol) |
| 8 mg | succinic acid |
| 6.00 g | dichloromethane |

Barrier Layer A:

The barrier layer was coated at 4 mil wet thickness on top of the previous coating and air dried. Polyvinyl alcohol solutions did not coat well and it was necessary to add ethanol and a surfactant to induce the proper wetting.

| | |
|---|---|
| 0.5 g | polyvinyl alcohol (Aldrich, #18,933-2) |
| 1 mil | ethanol |
| 1 drop | Liquinox TM (a non-ionic surfactant) |
| 9.5 g | water |

Magenta Layer:

The magenta layer was coated at 4 mil wet thickness and air dried.

| | |
|---|---|
| 1.13 g | Saran TM 310 (Dow Chemical, Midland, MI) |
| 0.08 g | magenta leuco dye (formula shown below was prepared according to the method of U.S. Pat. No. 4,647,525 |

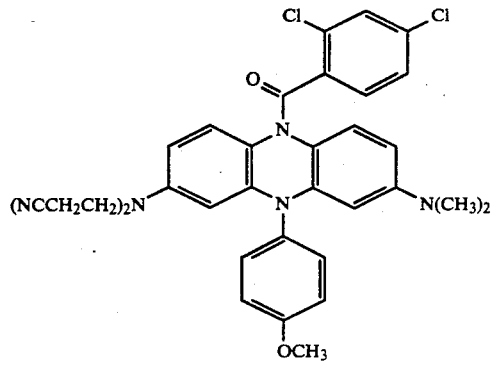

| | |
|---|---|
| 0.06 g | 1-methyl-3,5-trichloromethyl-s-triazine (MBTS) |
| 2.0 mg | EG1 sensitizing dye (EG1 is 5,10-diethoxy-16,17-dimethoxyviolanthrene which was prepared according to the procedure of U.S. Pat. No. 3,799,779) |
| 0.92 g | lithium nitrate solution I (0.14 g lithium nitrate and 0.14 g succinic acid in 9 g methanol) |
| 6.37 g | methyl ethyl ketone |

This coating was tested by contact printing a graded-wavelength interference filter, having a neutral density step-wedge perpendicular to the wavelength variation, onto the material. An exposure of 20 sec. to a 150 watt photo flood lamp at a distance of about 50 cm, followed by 10 sec thermal development at 93° C. gave an image with two peaks. The peak corresponding to EG1 sensitization (550 nm) was magenta, and the peak corresponding to SCB squarylium sensitization was cyan. Where exposed to white light, the coating was blue (magenta plus cyan).

EXAMPLE 2

This example demonstrates a multilayer 3-color coating. The following coating formulations are listed in the order that they were coated onto the film base.

| Yellow layer: | |
|---|---|
| 1.5 g | PKHH TM |
| 0.05 g | MBTS |
| 1.25 g | $LiNO_3$, II solution (9 g methanol, 0.3 g $LiNO_3$, 0.01 g succinic acid) |
| 4.0 mg | 1,5-bis(4-dimethylaminophenyl)-1,4-pentadien-3-one (DMBA), prepared according to Olumucki, M.; Le Gall, J.Y., Bull Soc. Chim Fr. 1976, 9–10, pt. 2, 1467–8 |
| 3.0 mg | phenidone |
| 3.0 g | methyl ethyl ketone |
| 3.0 | toluene |
| 0.10 g | yellow leuco (formula shown below, was prepared according to the method of U.S. Pat. No. 4,647,525: |

-continued

Yellow layer:

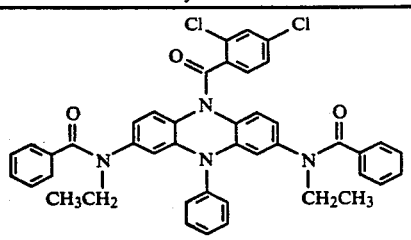

Barrier Layer:

8 percent Elvanol TM 50–42 (a polyvinyl alcohol available from DuPont, Wilmington, DE) in 9/1 water-/ethanol mixture.

| Cyan Layer: | |
|---|---|
| 3.00 g | PKHH TM |
| 0.12 g | Pergascript TM Turquoise |
| 0.08 g | diphenyliodonium hexafluorophosphate (prepared according to U.S. Pat. No. 4,026,705) |
| 1.84 g | magnesium nitrate solution (0.39 g magnesium nitrate hexahydrate, 0.21 g succinic acid, 9.0 g ethanol) |
| 8 mg | C1A (oxonol sensitizing dye) |

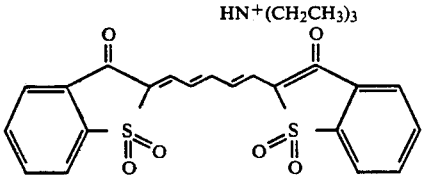

| | |
|---|---|
| 6.0 g | acetone |
| 6.0 g | toluene |

Barrier layer:

The same formulation was used as in the previous barrier layer.

| Magenta layer: | |
|---|---|
| 3.0 g | PKHH TM |
| 0.16 g | magenta leuco dye |
| 0.10 g | diphenyliodonium hexafluorophosphate |
| 0.78 g | magnesium nitrate solution as above |
| 1.83 g | mixed nitrate solution I (0.39 g magnesium nitrate hexahydrate, 0.189 g lithium nitrate, 0.21 g succinic acid, 9.0 g methanol) |
| 6.0 g | acetone |
| 6.0 g | toluene |
| 8 mg | M4A (oxonol sensitizing dye) |

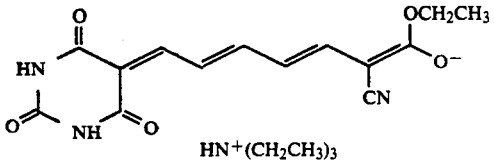

The layers were coated onto a base of 4 mil (0.01 mm) polyethylene terephthalate film in the following order: yellow layer (5 mil wet thickness), barrier layer (2 mil wet thickness), cyan layer (3 mil wet thickness, barrier layer (2 mil wet thickness), and magenta layer (4 mil wet thickness).

The coated construction prepared above was evaluated during assembly by removing portions for thermal testing. Test results were as follows:

| Coating | Thermal Test: Exposure Time (sec) | Development Temperature (°C.)[a] exposed | Development Temperature (°C.)[a] unexposed |
|---|---|---|---|
| yellow + barrier | 20 | 65 | 98 |
| | 40 | 70 | 105 |
| yellow + barrier + cyan + barrier | 40 | <60/80 | 105/105 |
| yellow + barrier + cyan + barrier + magenta | 20 | <60/80/80 | 110/105/105 |

[a]Numbers in the "Development Temperature" columns refer to the temperatures of development of the respective layers, in the respective order given in the "Coating" column. Development temperatures were determined using a Reichert Heizbank thermal gradient bar (Cambridge Instruments, Buffalo, NY).

A repeat of the above procedure gave:

| Coating | Thermal Test: Exposure Time (sec) | Development Temperature (°C.)[a] exposed | Development Temperature (°C.)[a] unexposed |
|---|---|---|---|
| yellow + barrier + | 20 | <60/80/80 | 110/100/110 |
| cyan + barrier + magenta | 40 | 60/80/75 | 110/95/100 |

[a]Numbers in the "Development Temperature"columns refer to the temperatures of development of the respective layers, in the respective order given in the "Coating" column. Development temperatures were determined using a Reichert Heizbank thermal gradient bar.

EXAMPLE 3

This example illustrates another full color photothermographic construction.

In this example, two coatings were made differing in the sensitizing systems used in the cyan layer. This is to demonstrate some of the options available in formulation constructions of this kind.

| Yellow layer: | |
|---|---|
| 3.0 g | PKHH TM |
| 0.2 g | yellow leuco dye |
| 1.84 g | $LiNO_3$, III solution (9.0 g methanol, 0.2 g lithium nitrate, 0.12 g succinic acid) |
| 0.1 g | diphenyliodonium hexafluorophosphate |
| 8 mg | Y1A (oxonol sensitizing dye) |

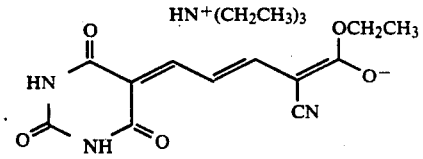

| | |
|---|---|
| 6.0 g | acetone |
| 6.0 g | toluene |

| Cyan formulation #1: | |
|---|---|
| 3.0 g | PKHH TM |
| 0.16 g | Pergascript TM Turquoise S-2G |
| 0.12 g | MBTS |
| 1.84 g | magnesium nitrate solution |
| 4 mg | SCB squarylium |
| 4 mg | SCB squarylium |
| 6.0 g | acetone |
| 6.0 g | toluene |

| Cyan formulation #2: | |
|---|---|
| 3.0 g | PKHH TM |

-continued

| | |
|---|---|
| 0.16 g | Pergascript TM Turquoise S-2G |
| 0.08 g | diphenyliodonium hexafluorophosphate |
| 1.84 g | magnesium nitrate solution |
| 8 mg | C1A (oxonol sensitizing dye) |
| 6.0 g | acetone |
| 6.0 g | toluene |
| | Magenta formulation: |
| 3.0 g | PKHH TM |
| 0.16 g | magenta leuco dye |
| 2.6 g | $LiNO_3$, III solution |
| 0.1 g | diphenyliodonium hexafluorophosphate |
| 8 mg | M4A (oxonol sensitizing dye) |
| 6.0 g | acetone |
| 6.0 g | toluene |

Barrier layer formulation:

As given in Example 2 above.

Layers were coated onto a 4 mil polyethylene terephthalate base in the following order: yellow layer (4 mil wet thickness), barrier layer (2 mil wet thickness), cyan layer (4 mil wet thickness), barrier layer (2 mil wet thickness), magenta layer (4 mil wet thickness).

| | Thermal Test | | |
|---|---|---|---|
| | Exposure Time (sec) | Development Temperature (°C.) exposed | unexposed |
| yellow | 20 | 90 | 100 |
| yellow + barrier | 20 | 90 | 100 |
| yellow + barrier + cyan(C1A) + barrier | 20 | 90/90 | 100/100 |
| yellow + barrier + cyan(SCB) + barrier | 20 | 90/<60 | 95/90 |
| yellow + barrier + cyan(SCB) + barrier + magenta | 20 | 90/<60/100 | 100/90/100 |
| yellow + barrier + cyan(C1A) + barrier + magenta | 20 | 90/90/90 | 105/100/115 |

In the above example, the yellow layer was next to the film base. In this construction, the cyan layer using C1A as the sensitizing dye was considered superior. The layer containing MBTS and squarylium dye appears to develop at a low temperature because this sensitizer/initiator combination is very light sensitive.

EXAMPLE 4

This example demonstrates the use of coating pH variation to adjust imaging behavior. A series of 2-color coatings was made to demonstrate the effect of changing the pH of the barrier layer. The value of being able to alter the development temperatures of the layers, relative to one another, is that sometimes it is difficult to predict the exact temperature at which a particular layer will develop. The development temperatures also change when layers are supercoated. By adjusting the pH of the interlayers, fine control can be exercised over layer behavior.

| | Magenta Layer: |
|---|---|
| 3.0 g | PKHH TM |
| 0.16 g | magenta leuco dye |
| 0.08 mg | M4A (oxonol sensitizing dye) |
| 1.84 g | $LiNO_3$ III |
| 0.08 g | diphenyliodonium hexafluorophosphate |
| 6.0 g | acetone |

-continued

| | Magenta Layer: |
|---|---|
| 6.0 g | toluene |

This was coated 4 mil wet onto 4 mil polyethylene terephthalate film using a continuous roll coater at 3 feet per minute and a drying temperature of 65° C. in an 8 foot oven. Similar drying conditions were used for the other layers.

| | Cyan layer: |
|---|---|
| 3.0 g | PKHH TM |
| 0.16 g | Copikem TM II (Hilton-Davis, Cincinnati, OH) |
| 0.08 mg | C1A (oxonol sensitizing dye) |
| 1.84 g | magnesium nitrate solution |
| 0.08 g | diphenyliodonium hexafluorophosphate |
| 6.0 g | acetone |
| 6.0 g | toluene |

Interlayer:

8 percent polyvinyl alcohol Elvanol TM 71-30 in 9:1 water/ethanol, pH 6.35. This was adjusted to pH=3.62 with succinic acid, and divided into four batches. Sodium hydroxide solution was added to these batches to produce pH values of 4.57, 9.50 and 10.40.

After coating these materials were tested by giving 20 second exposure to one half of the strip and developing the whole strip on a Reichert Heizbank thermal gradient bar. The results of testing follow:

| | Cyan layer alone: Development Temperature of Cyan (°C.) | |
|---|---|---|
| Interlayer pH | Exposed | Unexposed (°C.) |
| 3.62 | 80 | 95 |
| 4.57 | 85 | 100 |
| 9.50 | 90 | 105 |
| 10.50 | 90 | 100 |
| Cyan, no interlayer | 80 | 100 |

A two color construction was prepared by coating the following layers onto 4 mil polyethylene terephthalate: cyan layer (4 mil wet thickness), barrier layer (2 mil wet thickness), magenta layer (4 mil wet thickness.

| | Development Temperature of Cyan (°C.) | | | |
|---|---|---|---|---|
| Interlayer | cyan C1A (on bottom) | | magenta (on top) | |
| pH | exposed | unexposed | exposed | unexposed |
| 3.62 | 75 | 90 | 90 | 100 |
| 4.57 | 85 | 110 | 75 | 100 |
| 9.50 | 90 | 100 | 100 | 105 |
| 10.50 | 85 | 105 | 85 | 105 |

These materials were also exposed to a step wedge and developed at 99° C. Going down the pH series, steps 7, 8, 8, and 10 developed, showing how light sensitivity also varied.

EXAMPLE 5

This example shows that high pH interlayers were not always desired. The samples were prepared according to the procedures of example 4. In this example, the lowest pH formulation has the most desirable properties.

| Interlayer pH | Development Temperature of Cyan (°C.) magenta alone exposed | magenta alone unexposed | cyan coated onto magenta exposed | cyan coated onto magenta unexposed |
|---|---|---|---|---|
| 3.62 | 70 | 90 | 75/95 | 75/95 |
| 4.57 | 70 | 100 | 75/200 | 75/100 |
| 9.50 | 70 | 90 | 85/100 | 75/100 |
| 10.50 | 70 | 100 | 75/100 | 75/80 |
| no interlayer | 70 | 80 | — | — |

EXAMPLE 6

This example demonstrates that pH of barrier layers affects the observed photothermographic speed of the adjacent imaging layers. The following table was obtained for the cyan (top)/magenta (bottom) construction of example 5, and developed according to the procedure of example 4. A large number of steps developed indicates a higher sensitivity.

| Interlayer pH | Development Temperature (°C.) | Exposure Time (sec.) | Steps Developed |
|---|---|---|---|
| 3.62 | 91 | 17.5 | 12–13 |
| 4.57 | 91 | 17.5 | 11–12 |
| 9.50 | 91 | 17.5 | 9–10 |
| 10.40 | 93 | 17.5 | 11 |
| no interlayer | 82 | 17.5 | 5 |

EXAMPLE 7

This example demonstrates that only barrier layers with $E_p$ values of less than about 30 kJ/mol successfully function as barriers in the present invention.

| Polymer | Barrier Layer Materials: Effective Barrier Layer | Permeability[1] | Activation Energy of Permeability $E_p$ kJ/mol |
|---|---|---|---|
| Poly(vinyl chloride-vinyl acetate)[2] | no | 24 | 41 |
| Polyvinyl chloride[3] | no | 1.2 | 55.6 |
| Polyvinyl alcohol | yes | 0.0089 | 19 ($H_2O$) |
| Ethyl cellulose | yes | 26.5 | 16 |
| Polyethylene terephthalate | yes | 0.3 | 27 |
| Saran TM (copolymer of acrylonitrile and vinylidene chloride)[4] | no | 0.05 | 67 |
| Pliolite TM (styrenebutadiene rubber latex)[5] | borderline | 172 | 30 |
| Cellulose acetate | yes | 7.8 | 21 |
| Kel F800 TM (copolymer of chlorotrifluoroethylene and vinylidene fluoride)[6] | borderline | 6.75 | 15.5 |
| Daran TM 820 (vinylidene acrylate copolymer)[7] | no | approx. 21 | >40 |
| Polyvinyl acetate | no | 0.5 | 56.1 |
| Polysar TM 346 (ethylene-propylene rubber)[8] | no | — | 46 |

[1]permeability to oxygen at 25 to 30° C. as defined below:

-continued

| Polymer | Barrier Layer Materials: Effective Barrier Layer | Permeability[1] | Activation Energy of Permeability $E_p$ kJ/mol |
|---|---|---|---|

$$p = \frac{(cm^3 \text{ at STP})(\text{mm thickness}) \times 10^{10}}{(cm^3 \text{ area})(\text{sec})(\text{cm Hg})}$$

[2]VAGH, Union Carbide, Hachensack, NJ.
[3]Geon TM 178, B. F. Goodrich, Cleveland, OH.
[4]Dow Chemical, Midland, MI.
[5]Goodyear Chemical, Akron, OH.
[6]3M Company, St. Paul, MN
[7]W. R. Grace, Baltimore, MD.
[8]Polysar, Akron, OH.

We claim:

1. A photothermographic construction comprising a substrate coated thereon with at least two light-sensitive layers, wherein said light-sensitive layers comprise a nitrate salt, leuco dye, and a binder; and further wherein: (a) at least one pair of said light-sensitive layers is separated by a barrier layer comprising a polymer having an $E_p$ value of less than about 30 kJ/mole; and (b) said barrier layer and said light-sensitive layers are substantially insoluble in one another.

2. A photothermographic construction according to claim 1 consisting essentially of three light-sensitive layers which are sensitive to red, green, and blue light, respectively.

3. A photothermographic construction according to claim 1 wherein said substrate is a metal, inorganic film, paper, or glass.

4. A photothermographic construction according to claim 1 wherein nitrate salt is an inorganic salt.

5. A photothermographic construction according to claim 4 wherein said nitrate salt is a hydrated metal salt.

6. A photothermographic construction according to claim 1 wherein at least 0.10 moles of nitrate ion are present per mole of leuco dye.

7. A photothermographic construction according to claim 1 wherein said leuco dye is oxidazable.

8. A photothermographic construction according to claim 7 wherein said leuco dye is chosen from the group consisting of acylated leuco diazine, phenoxazine, and phenothiazine dyes.

9. A photothermographic construction according to claim 1 wherein said leuco dye is present in an amount of at least about 0.3 weight percent of the total weight of said light sensitive layer.

10. A photothermographic construction according to according to claim 1 wherein said binder is a thermoplastic resin.

11. A photothermographic construction according to claim 1 wherein said light-sensitive layer further comprises a photoinitiator.

12. A photothermographic construction according to claim 1 wherein said photoinitiator is a diaryl iodonium salt.

13. A photothermographic construction according to claim 1 comprising three light-sensitive layers which are sensitive to red, green, and blue light, respectively.

14. A photothermographic construction according to claim 1 wherein said polymers in said barrier layer are individually selected from the group consisting of: polyacrylamide, polyvinyl alcohol, ethyl cellulose, polyethylene terephthalate, styrene, butadiene copolymers, cellulose acetate, chlorotrifluoroethylene, and vinylidene fluoride copolymers.

15. A photothermographic construction according to claim 13 wherein said barrier layer is water soluble and organic solvent insoluble.

16. A photothermographic construction according to claim 13 wherein the individual thickness of said barrier layers is in the range of about 1 to 20 microns.

* * * * *